US005740944A

United States Patent [19]

Crawford

[11] Patent Number: 5,740,944

[45] Date of Patent: Apr. 21, 1998

[54] SOCK STORAGE AND DISPENSER

[76] Inventor: Arthur D. Crawford, 12 Rockford Pl., Rome, Ga. 30165-1728

[21] Appl. No.: 625,817

[22] Filed: Apr. 1, 1996

[51] Int. Cl.[6] ..... B65G 59/00

[52] U.S. Cl. ..... 221/134; 312/42

[58] Field of Search ..... 221/282, 283, 221/197, 134; 312/42, 35, 45; 206/292, 278

[56] References Cited

U.S. PATENT DOCUMENTS

| | | | |
|---|---|---|---|
| 1,244,889 | 10/1917 | Patterson | 221/134 |
| 4,123,125 | 10/1978 | Andry, III | 312/42 |
| 5,370,220 | 12/1994 | Wang | 312/42 |

*Primary Examiner*—Kenneth Noland

*Attorney, Agent, or Firm*—Harry I. Leon; Vivian L. Steadman

[57] ABSTRACT

An apparatus having a plurality of elongated, open channels for storing, displaying and dispensing rolled socks. Terminating at its lower end in a base, each channel defines an elongated viewing slot which extends vertically substantially the length thereof. So that socks inserted through the slot drop downwardly within the channel to be supported by the base, the minimum span of a transverse cross-section of each channel is somewhat larger than the diameter of a pair of rolled socks. At the same time, both the channel and the slot are sufficiently narrow to retain pairs of rolled socks in magazine type fashion. Socks located in any position within the confines of one of the channels can be readily removed therefrom through its respective viewing slot. The apparatus also includes a mounting frame so that the unit can be either flush or surface mounted on a wall.

5 Claims, 3 Drawing Sheets

SOCK STORAGE AND DISPENSER

BACKGROUND OF THE INVENTION

The present invention relates to an apparatus for storing and dispensing pairs of rolled socks in a magazine type fashion.

The prior art includes U.S. Pat. No. 5,147,119. Therein Harris discloses an elongated tubular member which defines a storage compartment having an open upper end into which pairs of rolled socks can be dropped and a flared opening in the side of the member proximate with its base through which socks can be withdrawn. Rolls of socks are stored one on top of the other and are viewable through an axially extending slot. Unless the tubular member is tipped upside down, only the pair of socks which has slid furthest downwardly in the compartment can be removed at any given time.

SUMMARY OF THE INVENTION

The primary object of this invention is to provide an improved apparatus for storing, displaying and dispensing pairs of rolled socks which not only allows multiple pairs of socks to be displayed simultaneously in an array but also facilitates removal of an individual pair of socks therefrom regardless of its position within the array.

A further object of this invention is to offer such an apparatus, which can be either freestanding or wall mounted, in which contiguous pairs of socks are disposed generally vertically of each other.

The apparatus according to the present invention comprises a structure having a plurality of elongated storage compartments in which contiguous compartments preferably share a common side wall. Terminating at its lower end in a base, the structure defines for each compartment an elongated viewing slot which communicates therewith and extends vertically substantially the length thereof. Pairs of rolled socks can be deposited within each compartment by inserting them through the elongated slot associated with it. The minimum span of a transverse cross-section of each compartment is preferably somewhat larger than the diameter of a pair of rolled socks. If the walls of the compartment are slick, the socks, once they have been inserted through the slot, tend to drop downwardly to be supported by the base or by other socks already deposited proximate with it. In such a case, the compartment is also sized so that it is narrow enough to hold several pairs of rolled socks in a magazine type array. Providing access to each compartment is a slot which is both sufficiently narrow in its transverse width to retain rolled socks within the compartment and sufficiently wide to allow to any individual pair of socks located within the compartment, upon the socks being slightly compressed, to be readily removed from any position within the compartment or, alternately, added thereto.

In the preferred embodiment, the apparatus includes a mounting frame with a flange which can be utilized to mount it flush with a wall.

DETAILED DESCRIPTION OF THE PREFERRED EMBODIMENT

Figure 1:
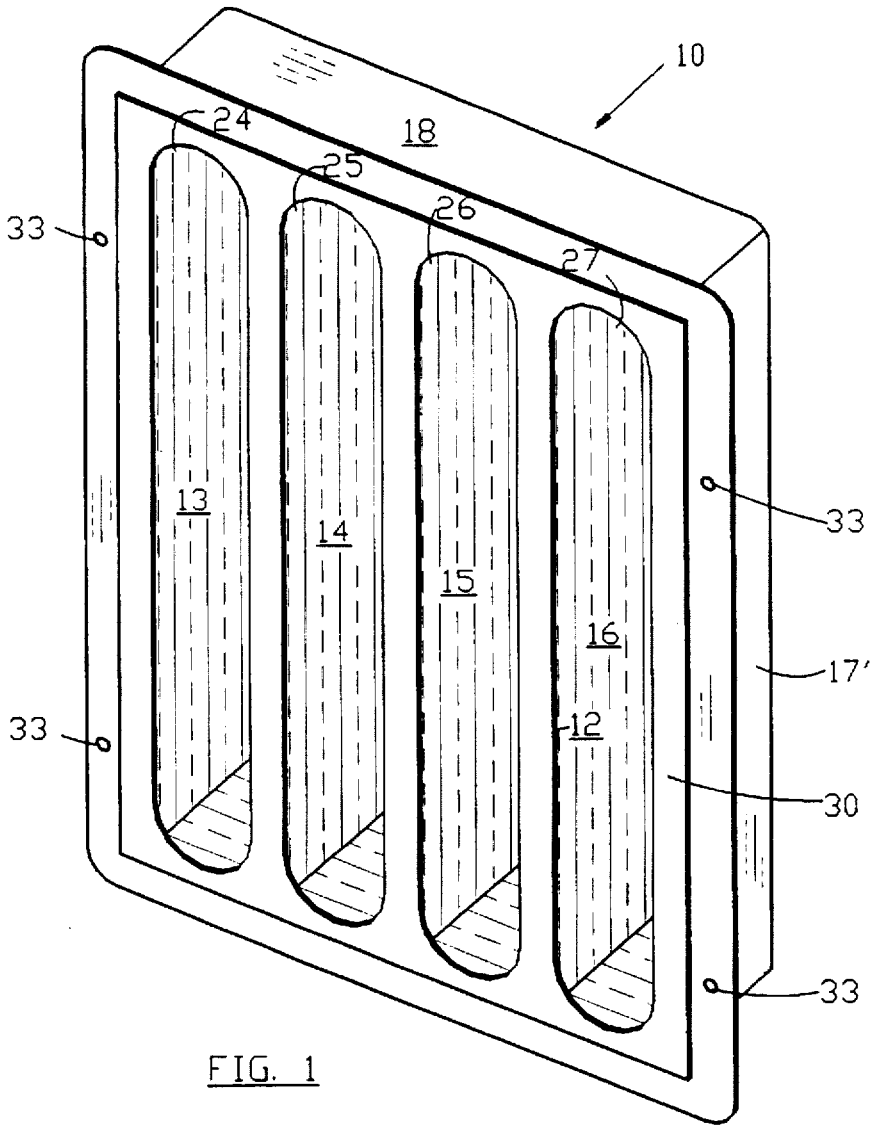
FIG. 1 is a perspective view of the apparatus according to the present invention.

In accordance with the invention, an improved sock storage and dispensing apparatus, indicated generally by the reference numeral 10, comprises a structure 11 and a mounting flange 30. The unit 11 defines a plurality of elongated compartments 13, 14, 15, 16. Each contiguous pair of these compartments 13, 14; 14, 15; 15, 16 share a common interior side wall.

Figure 2:
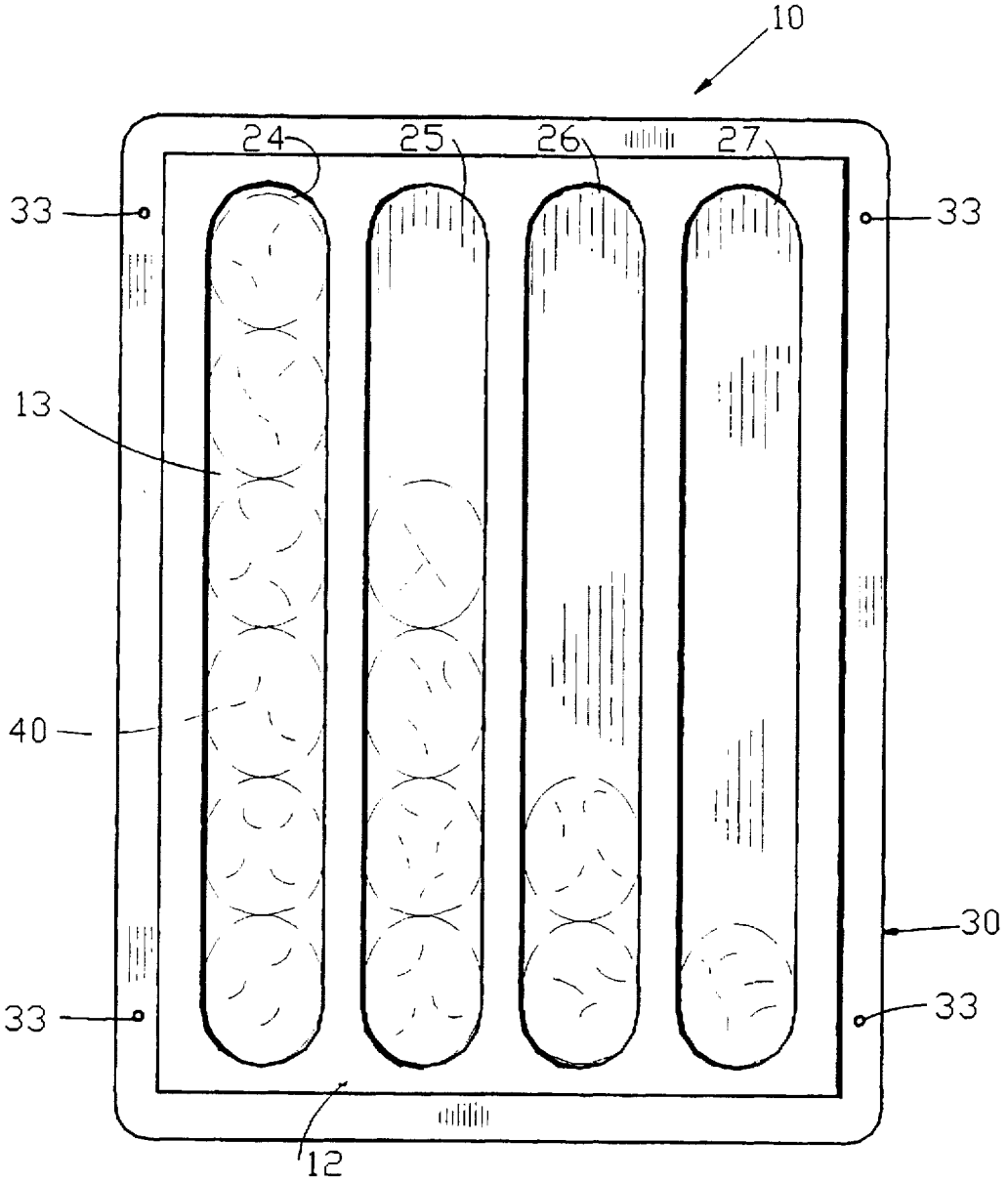
FIG. 2 is a frontal elevational view of the apparatus according to FIG. 1, pairs of rolled socks stored within the apparatus being illustrated by dashed lines superimposed thereupon.
Figure 4:
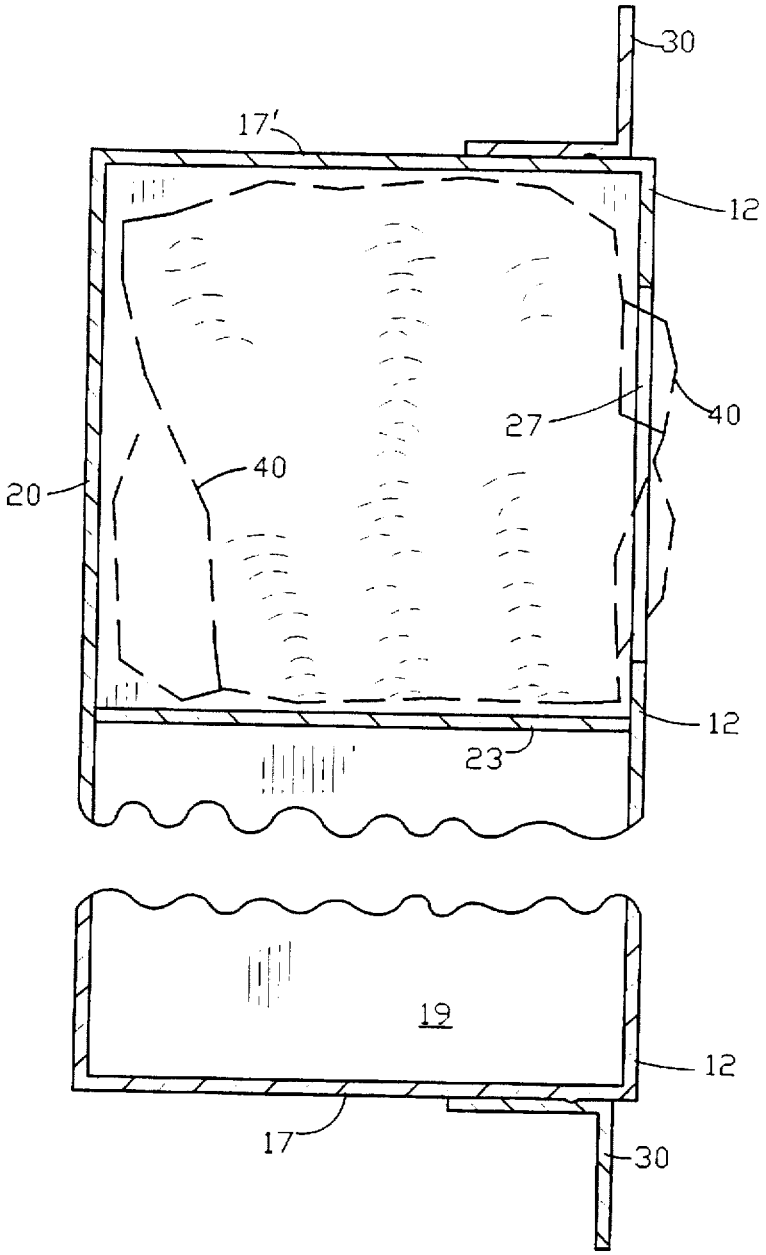
FIG. 4 shows, on an enlarged scale, transverse cross-sections of fragmentary portions of the apparatus.

As is best illustrated in FIGS. 1–2 and 4, the structure 11 includes a front wall 12 and a rear wall 20 joined together by the base 19, interior side walls 23 and exterior side walls 17, 17'. The apparatus 10 is preferably fabricated from plastic which measures, by way of example, about 0.070 inches in thickness; alternatively, wood or metal can be utilized. The front wall 12 defines for each compartment 13, 14, 15, 16 an elongated viewing slot 24, 25, 26, 27, respectively, which communicates therewith and extends vertically substantially the length thereof.

In the preferred embodiment, opposing ends of each compartment 13, 14, 15, 16 terminate in the base 19 and in a top plate 18. Rigidly joined to the side walls 17, 17' and back 20, the plate 18 keeps out dust and other debris, allowing the apparatus 10 to be mounted partly within the wall of a room, thereby saving space. On the other hand, when the apparatus 10 is to be mounted on the exterior surface of a wall or used in a freestanding mode, the compartments 13, 14, 15, 16 need not be covered.

In an apparatus 10 employed to display rolled pairs of socks 40 in men's sizes, each of the elongated compartments 13, 14, 15, 16 measures, by way of example, approximately 3.4 inches in transverse width; each of the slots 24, 25, 26, 27, on the other hand, is about 2.5 inches wide. Arranged side by side as in FIGS. 1–2, these four elongated compartments 13, 14, 15, 16 comprise an apparatus 10 which, in overall transverse width, measures about 14.25 inches. By compressing an individual pair of rolled socks 40 slightly and inserting it through the elongated slot 24, 25, 26, 27, the socks can be deposited within the compartment 13, 14, 15, 16, respectively. If the walls of the compartment are relatively smooth and the pair of socks 40 is small enough, it drops downwardly within the compartment to be supported by other socks already deposited within it or, in their absence, by the base 19. Alternatively, the pair of socks 40, as it is being inserted through the slot 24, 25, 26, 27, can be positioned between two pairs of socks already stacked within the compartment 13, 14, 15, 16.

As is best illustrated in FIG. 4, each compartment 13, 14, 15, 16 and its slot 24, 25, 26, 27 are sufficiently narrow in transverse cross-section that, when more than one pair of rolled socks 40 is deposited within the compartment, the pairs of socks 40 are maintained in an orderly array stacked one on top of the other. At the same time, each slot 24, 25, 26, 27 is wide enough to allow a person to reach through it and grasp any individual pair of socks located within the compartment and then, by compressing the socks slightly, remove that pair with ease from the apparatus 10.

Scaled down to accommodate rolled pairs of socks in women's and children's sizes, five elongated compartments, similar to compartments 13, 14, 15, 16 but smaller in transverse cross-section, can be incorporated into an apparatus according to the present invention having the same overall transverse width as the apparatus 10. Specifically, an apparatus having five elongated compartments each of which measures, by way of example, about 2.1 inches in transverse width and is accessible through an elongated slot which is about 1.5 inches wide has an overall transverse width of 14.25 inches.

With such a width, the apparatus 10 is sized so that it can be partly mounted between the studs of a conventionally-framed building having 2×4 studs on 16 inch centers. For convenience in mounting the apparatus 10 within a wall, the depth of the structure 11 in transverse cross-section is preferably at most of 3.75 inches. The length of the apparatus 10 is arbitrary. The flange 30 is preferably wide enough to cover any defects in installing the apparatus in the wall or allow surface mounting on the wall wherein the fastening to two adjacent studs can be accommodated.

Figure 3:
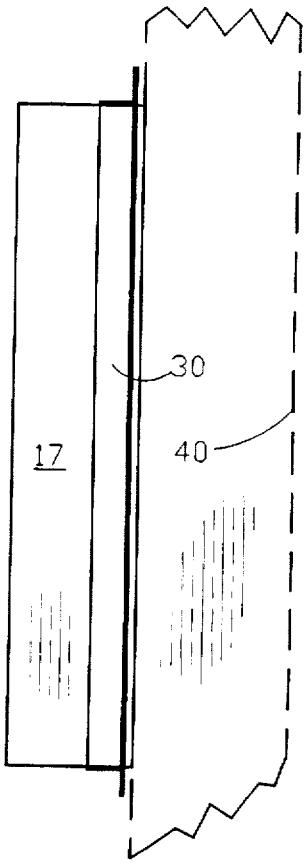
FIG. 3 shows a side elevational view of the apparatus according to FIG. 1 mounted on the exterior surface of a wall, the wall being shown in dashed lines.
Figure 5:
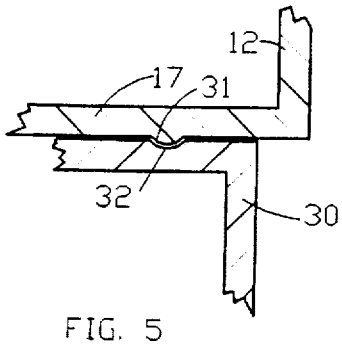
FIG. 5 shows, on a further enlarged scale, a fragmented segment of the cross-sections shown in FIG. 4.

In the preferred embodiment, the mounting flange 30 is slip fitted onto the structure 11. The flange 30 preferably extends from the top plate 18, base 19 and side walls 17, 17', respectively, a distance which measures about 1 inch and has holes 33 formed therein for receiving fasteners (not shown) attachable to a wall. Protrusions 31 disposed on the outside surfaces of the exterior side walls 17, 17', top plate 18, and base 19 are engageable with indentations 32 formed in the inside surfaces of the flange 30. The protrusions 31 and indentations 32 hold it and the structure 11 in assembled configuration (FIGS. 4 and 5). Other holding means such as pins or screws insertable in alignable holes (not shown) formed in the flange 30 and structure 11 can also be used. So that the apparatus 10 can be mounted as a built-in, the protrusions 31 are distributed on the structure 11 in such a way that the flange 30 can be secured to it in close proximity to the front wall 12 (FIGS. 1–2, 4). Alternatively, protrusions 31 situated near the rear wall 20 allow the flange 30 is to held on the structure 11 proximate with the rear wall 20 so that the apparatus 10 can be mounted on the exterior surface of a wall (FIG. 3).

It is understood that those skilled in the art may conceive other applications, modifications and/or changes in the invention described above. Any such applications, modifications or changes which fall within the purview of the description are intended to be illustrative and not intended to be limitative. The scope of the invention is limited only by the scope of the claims appended hereto.

I claim:

1. An apparatus for storing and dispensing pairs of rolled socks, comprising a structure having a base and a front wall, the structure defining at least one elongated channel which terminates at the base; the front wall defining an elongated slot of fixed dimensions through which any pair of rolled socks stored in the channel can be viewed; the channel, in transverse cross-section, being sized to accommodate only a single pair of rolled socks; the slot being substantially narrower in transverse width than the channel, the slot being both sufficiently narrow to retain pairs of socks within the channel and sufficiently wide to allow immediate access to any individual pair of socks stored within the channel regardless of whether any other pair of socks stored therewithin separates said pair from the base, so that said individual pair of socks, when slightly compressed, can be readily removed from the channel.

2. The apparatus according to claim 1 which further comprises means, including a frame adjustably fastened to the structure, for mounting the structure on a wall.

3. An apparatus for storing and dispensing pairs of rolled socks, comprising a structure having a base and a front wall, the structure defining a plurality of elongated channels; the front wall defining a plurality of elongated slots through which any pair of rolled socks stored in the channels can be viewed, each channel communicating with one of the slots and terminating at the base; the slot being substantially narrower than the channel with which the slot communicates but generally equal in length thereto; each channel, in transverse cross-section, being sized to accommodate only a single pair of rolled socks; each slot being both sufficiently narrow to retain pairs of socks within the channel with which the slot communicates and sufficiently wide to allow immediate access to any individual pair of socks stored therewithin regardless of whether any other pair of socks stored therewithin separates said pair from the base, so that said individual pair of socks, when slightly compressed, can be readily removed from the apparatus.

4. The apparatus according to claim 3 which further comprises means, including a frame adjustably fastened to the structure, for mounting the structure on a wall.

5. An apparatus for storing and dispensing pairs of rolled socks, comprising a structure having a base and a front wall, the structure defining a plurality of elongated channels; the front wall defining a plurality of elongated slots of fixed dimensions through which any pair of rolled socks stored in the channels can be viewed, each channel communicating with one of the slots and terminating at the base; each slot being substantially narrower in transverse width than the channel with which the slot communicates; each channel, in transverse cross-section, being sized to accommodate only a single pair of rolled socks; each slot being both sufficiently narrow to retain pairs of socks within the channel with which the slot communicates and sufficiently wide to allow immediate access to any individual pair of socks stored therewithin regardless of whether any other pair of socks stored therewithin separates said pair from the base, so that said individual pair of socks, when slightly compressed, can be readily removed from the apparatus.

* * * * *